US008459214B2

(12) United States Patent
Roth et al.

(10) Patent No.: US 8,459,214 B2
(45) Date of Patent: Jun. 11, 2013

(54) METHOD AND APPARATUS FOR EFFICIENT GENERATION OF HYDROGEN II

(75) Inventors: Vernon Roth, Westcliffe, CO (US); Gregory Sherman, New York, NY (US)

(73) Assignee: Common Sense Technologies, LLC, New York, NY (US)

( * ) Notice: Subject to any disclaimer, the term of this patent is extended or adjusted under 35 U.S.C. 154(b) by 0 days.

(21) Appl. No.: 13/289,574

(22) Filed: Nov. 4, 2011

(65) Prior Publication Data

US 2012/0064466 A1 Mar. 15, 2012

Related U.S. Application Data

(63) Continuation of application No. 12/323,215, filed on Nov. 25, 2008, now Pat. No. 8,082,890.

(51) Int. Cl.
*F02B 43/08* (2006.01)

(52) U.S. Cl.
USPC ..... 123/3; 123/1 R

(58) Field of Classification Search
USPC ..... 123/1 R, 2, 3, DIG. 12
See application file for complete search history.

(56) References Cited

U.S. PATENT DOCUMENTS

| | | | | |
|---|---|---|---|---|
| 4,048,383 | A * | 9/1977 | Clifford | 429/422 |
| 4,094,740 | A | 6/1978 | Lang | |
| 5,215,044 | A * | 6/1993 | Banzhaf et al. | 123/41.29 |
| 6,238,546 | B1 | 5/2001 | Knieper et al. | |
| 6,804,949 | B2 | 10/2004 | Andrews et al. | |
| 6,866,756 | B2 | 3/2005 | Klein | |
| 7,191,737 | B2 | 3/2007 | Klein | |
| 2004/0256247 | A1 | 12/2004 | Carson et al. | |
| 2005/0016840 | A1 * | 1/2005 | Petillo | 204/248 |
| 2005/0274607 | A1 | 12/2005 | Kitada et al. | |
| 2006/0180101 | A1 | 8/2006 | Monette | |
| 2006/0235088 | A1 | 10/2006 | Olah et al. | |
| 2006/0291822 | A1 | 12/2006 | Sheldon | |
| 2007/0012264 | A1 | 1/2007 | Holt et al. | |
| 2007/0054170 | A1 * | 3/2007 | Isenberg | 429/33 |
| 2007/0056569 | A1 | 3/2007 | Kleinberger | |
| 2008/0050631 | A1 * | 2/2008 | Ito et al. | 429/29 |

(Continued)

OTHER PUBLICATIONS

Drane, Keat B., "Convert Your Car to Alcohol", "Library of Congress Catalog Card 80-81750, ISBN 0-915216-54-X http://journeytoforever.org/biofuel_library/ethanol_drane.html", 1980, Page(s) Chapters 1-5, Publisher: Love Street Books.

(Continued)

*Primary Examiner* — Noah Kamen
*Assistant Examiner* — Long T Tran
(74) *Attorney, Agent, or Firm* — Kaplan Breyer Schwarz & Ottesen, LLP

(57) ABSTRACT

Apparatus for dissociating water into hydrogen and oxygen, comprising a tank and the quantity of water contained in said tank is dissolved. A quantity of a conductivity promoting material suspended or dissolved in said water to form an electrically conductive fluid and a plurality of plates suspended in said electrically conductive fluid and a reactive agent selected from the group consisting of derivatives of vegetable materials, derivatives of highly resinous vegetable materials, derivatives of vegetable materials taken from pinyon pine, derivatives of vegetable materials taken from dragon blood tree, water soluble derivatives of partially oxidized vegetable materials, water soluble derivatives of partially oxidized highly resinous vegetable materials, water soluble derivatives of partially oxidized vegetable materials taken from pinyon pine, and water soluble derivatives of partially oxidized vegetable materials taken from dragon blood tree.

19 Claims, 4 Drawing Sheets

U.S. PATENT DOCUMENTS

| | | | | |
|---|---|---|---|---|
| 2008/0116063 | A1* | 5/2008 | Yamada et al. | 204/284 |
| 2009/0014336 | A1 | 1/2009 | Olah et al. | |
| 2009/0061268 | A1* | 3/2009 | Gil et al. | 429/21 |
| 2009/0130016 | A1 | 5/2009 | Mills | |
| 2009/0194421 | A1 | 8/2009 | Sato et al. | |
| 2009/0277799 | A1 | 11/2009 | Grimes | |
| 2010/0025234 | A1* | 2/2010 | Hwang | 204/240 |
| 2010/0181190 | A1* | 7/2010 | Romaniuk | 204/274 |
| 2010/0282599 | A1* | 11/2010 | Jang et al. | 204/242 |
| 2010/0287826 | A1* | 11/2010 | Hoffman et al. | 44/605 |
| 2011/0005939 | A1* | 1/2011 | Haywood | 205/630 |
| 2011/0008736 | A1* | 1/2011 | Arai | 431/8 |

OTHER PUBLICATIONS

Reed et al., "Methanol: A Versatile Fuel for Immediate Use", "www.woodgas.com/Science1.pdf", Dec. 28, 1973, pp. 1299-1304, vol. 182.

Young, Lee W., "PCT Application No. PCT/US2009/65937 International Search Report Apr. 22, 2010", , Publisher: PCT, Published in: PCT.

Tran, Long T., "U.S. Appl. No. 12/323,215 Notice of Allowance Sep. 21, 2011", , Publisher: USPTO, Published in: US.

Tran, Long, "U.S. Appl. No. 12/323,215 Office Action Mar. 18, 2011", , Publisher: USPTO, Published in: US.

* cited by examiner

34
O2
54
56
H2
52
44
58
50
62
60
32
+
-

22
24
40
18
42
12
34
20
28
36
44
26
H2
O2
-

METHOD AND APPARATUS FOR EFFICIENT GENERATION OF HYDROGEN II

TECHNICAL FIELD

The invention relates to methods and apparatus for increasing the efficiency of an internal combustion engine, such as that powering an automobile, through the introduction of hydrogen and oxygen produced by an onboard electrolyzer subsystem thus resulting and lowered emissions.

CROSS REFERENCE TO RELATED APPLICATIONS

This application is a continuation of U.S. patent application Ser. No. 12/323,215 filed Nov. 25, 2008 now U.S. Pat. No. 8,082,890.

STATEMENT REGARDING FEDERALLY SPONSORED RESEARCH OR DEVELOPMENT

Not applicable.

BACKGROUND OF THE INVENTION

Addressing any serious problems presented involves a strategy of conservation of resources, coupled with increasing the efficiency with which fuels achieve desired objectives and decreasing the emission of pollutants.

In the case of large facilities, such as coal fired electric plants and the like, the size of the facility justifies the implementation of relatively elaborate technology, such as scrubbers for removing pollutants from the exhaust of a coal burning plant. Implementation of this Hydrogen technology is more cost-effective and will largely neutralize deleterious effects on the environment as well as improving efficiency.

However, one of the most serious sources of pollution is the personal automobile, as well as trucks and buses, which daily forge across the roads of this country. Moreover, some of the potential for improving operation of the internal combustion engine may readily be appreciated when it is considered that the efficiency of such engines is on average, between 15 and 25%.

Pollution from automobiles, mostly in the form of carbon dioxide, carbon monoxide and unburnt hydrocarbon emissions, presents a serious problem because each automobile requires its own individual means of addressing the problem. While pollution control valves, cleaner gasoline and other advances have done much to alleviate the problems involved in gasoline vehicle pollution, much more needs to be done, as the world heads for what may potentially be a very substantial crisis.

It is known that virtually every existing engine application from lawnmowers to automobiles to trucks to locomotives can benefit from the addition of hydrogen. Benefits include more power and longer engine life but the most astonishing of all are Minus Emissions. That is, with enough hydrogen, the exhaust gasses are cleaner than the air that enters the engine. Levels of carbon monoxide, un-burnt hydrocarbons, tire particles and diesel soot are reduced as air is cleaned by the hydrogen combustion. This increases efficiency of the engine and pollutants are reduced to harmless gasses and water vapor.

SUMMARY OF THE INVENTION

Apparatus for dissociating water into hydrogen and oxygen, comprises a tank and a quantity of water contained in the tank. A quantity of a conductivity promoting material is suspended or dissolved in the water to form an electrically conductive fluid. A plurality of plates are suspended in the electrically conductive fluid. A reactive agent selected from the group consisting of derivatives of vegetable materials, derivatives of highly resinous vegetable materials, derivatives of vegetable materials taken from pinyon pine (Pinus aristata), derivatives of vegetable materials taken from dragon blood tree (Dracaena cinnabari), water soluble derivatives of partially oxidized vegetable materials, water soluble derivatives of partially oxidized highly resinous vegetable materials, water soluble derivatives of partially oxidized vegetable materials taken from pinyon pine, and water soluble derivatives of partially oxidized vegetable materials taken from dragon blood tree are suspended or dissolved in the water.

The reactive agent may be made by collecting a quantity of organic material, at least partially oxidizing organic material, placing the oxidized organic material in a vessel; introducing water into said vessel; heating the contents of said vessel; maintaining temperature of the contents of said vessel for a period of time; allowing the temperature of the contents of vessel to drop over a period of time; filtering out solids from the contents of vessel to generate said reactive agent. The water may comprise energized water, such as available from Ancient Transformational Technologies of Westcliffe, Co. (www.ancienttek.com) under the brand name AETHERICALLY CHARGED WATER. The water may comprise triple distilled or a mixture of triple distilled and energized water. The water may comprise de-ionized water. The water may preferably comprise non-energized and energized water in a ratio of approximately six parts non-energized water to one part energized water. The water may comprise non-energized and energized water in a ratio of approximately five to seven parts non-energized water to one-quarter to two parts energized water. The plates may comprise stainless steel plates that have been subjected to an electrical potential in an electrolytic solution and periodically cleaned. The plates may also comprise a metal that is substantially non-reactive in a mixture of the water, reactive agent and conductivity promoting material under the application of electrical power to the apparatus. The inventive system may further comprise an internal combustion engine and a coupling sending dissociated hydrogen and oxygen to (i) an air intake on the internal combustion engine, (ii) a fuel material associated with the engine, or (iii) a cylinder of the internal combustion engine. The plates may reach a level higher than the water, reactive agent and conductivity promoting material. The plates are preferably not connected to each other by metallic conductors. The inventive engine may be powered by one or more hydrocarbon fuels selected from the group consisting of gasoline, diesel fuel, alcohol, petroleum biofuel, biological derivatives and petroleum derivatives.

A mixture of hydrogen and oxygen in the stoichiometric ratio of water, for example as released from the electrolysis of water, may be added to the air intake of an internal combustion engine or otherwise introduced into the combustion process, in accordance with the invention.

This compares with hydrogen injection in automobiles, which is a known method of improving engine efficiency. Hydrogen gas may be stored in a vehicle, for example compressed in a vessel at 3,600 to 10,000 psi for injection into the engine. This is costly and requires an infrastructure in industry outside of the vehicle itself.

Introduction of gases into the engine, in accordance with the invention, may be achieved by way of introducing the gas into the air intake or the atomized gasoline entrained in the air exiting a carburetor, or by injecting the gas into liquid gasoline prior to injection into the cylinder of the engine. Injection of appropriate amounts of free hydrogen into a cylinder of an internal combustion engine results in a more explosive mixture in accordance with the invention. The result is more complete combustion of hydrocarbons and, consequently, cleaner combustion.

The principal problem is how to efficiently generate hydrogen for storage and use over the long term. The mixture of hydrogen and oxygen is generally regarded as dangerously explosive as compared to pure hydrogen or oxygen. Typically, generating hydrogen and oxygen may be achieved using a hydrolyzer, also known as a hydrogen electrolyzer. Generally, a simple hydrolyzer comprises a container filled with distilled water in which sodium hydroxide (lye) or some other suitable conductive agent is dissolved in solution. Positive and negative electrodes are suspended in the solution and voltage is applied between the positive and negative electrodes. This causes oxygen to form at the positive electrode, and hydrogen to form at the negative electrode. These gases are allowed to mix and then introduced into an engine together with gasoline.

Hydrogen may also be obtained by other methods, such as steam reformation. This process is relatively efficient, involving heating metal, usually iron to red hot temperatures and allowing steam to pass over the surface. The oxygen binds to the metal, forming an oxide, which may have commercial value as a pigment useful in applications ranging from cement to paints. In this process hydrogen atoms are released and may be drawn off and compressed for storage and later use.

Solar energy may also be used to generate hydrogen from water.

In conventional hydrolyzers the suspension of electrodes in the caustic solution coupled with the application of electricity to the electrodes results in rapid degradation of the electrodes and resultant inefficiency and, ultimately, failure of the system.

In accordance with the invention, means are provided for more efficiently extracting energy from the engine while at same time reducing pollution.

In accordance with the invention, an electrolyzer with electrodes having a surface which greatly extends electrolyzer life is provided. The invention also incorporates of a catalytic agent into the electrolyzer solution and the same significantly contributes to the longevity of the system and its effectiveness. Generally, besides being used during the operation of the electrolyzer, the catalyst contributes to the surface treatment of the electrolyzer electrodes during what may be viewed as an initial "breaking in" period as will be described in detail below. This is achieved by applying electricity to the electrolyzer electrodes suspended in a solution of the catalyst in an electrolyzer, or in a dedicated electrode treatment device, much like an electrolyzer.

It is thus seen that the system of the present invention provides hydrogen on demand, as compared to the consumption of hydrogen, generated previously, for example, at a facility dedicated to same, which has been stored in compressed gas cylinders.

As an additional advantage, the amount of hydrogen present in the system is relatively small at any given point in time. Accordingly, the system of the present invention takes advantage of this condition to allow the hydrogen to mix with the oxygen. Undesired combustion is minimized or eliminated as the gases are present in small amounts, as compared to a reservoir of, for example, compressed hydrogen gas, or two compressed tanks filled with compressed oxygen and compressed hydrogen.

In accordance with the invention, oxygen and hydrogen are mixed with each other as they are being produced, for example in the precise stoichiometric ratio of water, that is two hydrogen atoms for each oxygen atom. This mixture is more combustible than the mixture of hydrogen and air. In accordance with the present invention, combustion of the same, as it is produced, improves horsepower and contributes to more complete combustion, thus improving efficiency and reducing pollutants.

It is recognized by the applicant that hydrogen will explode in a wide range of concentrations in the air, for example ranging between 5% to 70% hydrogen. However, characteristics and efficiency of the combustion will vary with the concentration of and the type of hydrogen in the mixture. Accordingly, preferably the system of the present invention utilizes hydrogen and oxygen in the above stoichiometric ratio, although other ratios will provide acceptable results, and under certain circumstances may meet or exceed performance characteristics of the stoichiometric ratio.

In accordance with the invention further efficiency may be achieved by implementing the particular modifications and adaptations of the electrolyzer as are described herein. As will be detailed below, a large number of electrodes suspended in a sodium hydroxide solution which also comprises a catalyst are configured in a series electrical circuit with the objective of limiting per cell voltage and current. The objective is to prevent overheating of the hydrolyzer. Such overheating represents power losses which should be avoided because they unduly increase the load which the hydrolyzer puts on an automobile generator used to power it. It is also believed that the series configuration results in the formation of a uniform magnetic field which may assist in the electrolysis.

A third aspect of the technology disclosed herein, which may be incorporated into the system in accordance with the invention, is to use a combination of inventive features to separate the hydrogen from the oxygen in the water used to fuel combustible gas generation in accordance with the present invention. More particularly, a catalytic material is introduced into the sodium hydroxide solution, as noted above.

In accordance with the invention, high-grade stainless steel plates may be used to form the conductive electrodes in the electrolyzer.

BRIEF DESCRIPTION THE DRAWINGS

The operation of the invention will become apparent from the following description taken in conjunction with the drawings, in which.

DETAILED DESCRIPTION OF THE PREFERRED EMBODIMENTS

As noted above, in accordance with the invention a high oxygen reduction potential (ORP) catalyst is incorporated into the sodium hydroxide solution in the inventive electrolyzer to advantageously achieve operation of an electrolyzer with the minimal generation of heat and the avoidance of fouling of the hydrolyzer electrode surfaces. The result is high efficiency and relatively long service life for the hydrolyzer and its electrodes. Moreover, the mixture of dissolved chemical compounds (e.g. sodium hydroxide, water and high ORP catalyst, whose preparation is described below) is used in preferred ratios which are believed to favor the hydrolysis reaction with a minimized generation of heat, functioning as a catalyst that contributes to breakage of the bonds between the oxygen and hydrogen in the water molecule. The chemical constituents sodium hydroxide, triple distilled water, and the high ORP catalyst, as well as the method for mixing and determining proper ratios are described below. This mixture of catalyst and other chemical constituents may be used in a series cell electrolysis device to create hydrogen and oxygen from water with high efficiency.

The preparation of triple distilled water is well-known, generally comprising three successive distillations. In each distillation stage water is boiled, for example in a retort or industrial equivalent, precipitated using a condenser and collected as the end product of the particular distillation stage and is input to the next distillation stage.

The sodium hydroxide solution to be incorporated into an electrolyzer or an apparatus dedicated to the conditioning or burning of electrodes or the electrolyzer, is prepared by first adding sodium hydroxide to the triple-distilled water. Typically, approximately 4.5 pounds of sodium hydroxide is added to about two gallons of water.

During the addition of sodium hydroxide to the water, the conductivity of the solution is monitored. When the maximum conductivity is reached, slightly more sodium hydroxide is added.

After such adding of the sodium hydroxide, the solution is allowed to cool to room temperature. It is important to add the energized water after the solution of distilled water and sodium hydroxide is mixed and thoroughly cooled, because the energized water generally accentuates and/or energizes reactions of chemical compounds to which it is added, as compared to ordinary water.

This could cause a number of problems. For example, the added heat may do damage to the system. Likewise, splashing, bubbling and other reactions may cause injury, make measurement of ingredients difficult, or the like.

Figure 1:
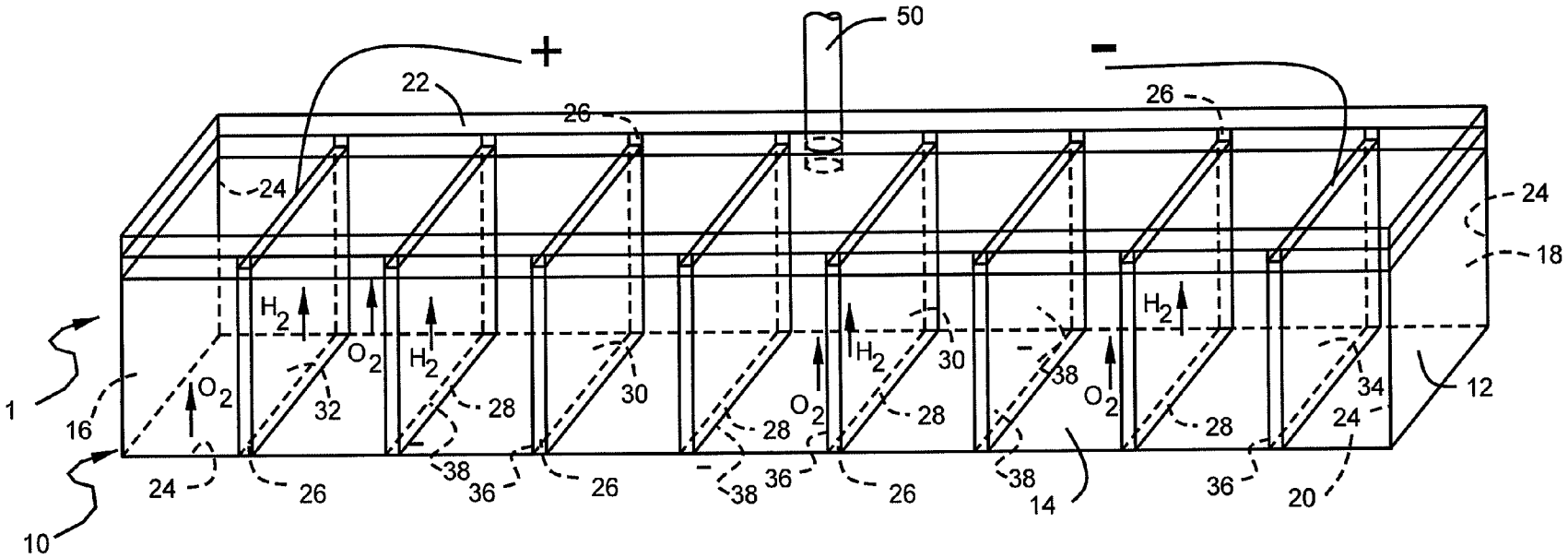
FIG. 1 is a schematic diagram generally illustrating the construction of a hydrolyzer or electrode conditioning apparatus in accordance with the present invention.

Referring to FIG. 1, the manufacture of a hydrolyzer 1 in accordance with the invention may be understood. In accordance with a preferred method, sodium hydroxide is mixed into two gallons of triple distilled water. The triple distilled water is held in a tank 10 made of, for example, plastic material, such as a suitable non-conductive, non-reactive material similar to Acrylic having an appropriate thickness, usually of 0.25 inches. The tank may be fabricated by having the plastic material cut into a plurality of sheets of plastic which function as sidewalls 12, 14, 16 and 18, a bottom 20 and a top cover 22. Sidewalls 12, 14, 16 and 18, and a bottom 20 are secured to each other to form a watertight tank.

Mechanical assembly and sealing of wall, bottom and top cover interfaces may also be employed.

As detailed above, sodium hydroxide of the quality detailed above is slowly added to the triple distilled water in tank 10. Conductivity of the liquid and tank 10 is monitored, and addition of sodium hydroxide is continued until conductivity peaks.

In another vessel, the high ORP fluid is mixed with triple distilled water in a ratio of 1 teaspoon of the catalytic high ORP fluid to 1 gallon of distilled water.

Sidewalls 14 and 18 are provided with a plurality of grooves 26. Bottom 20 is provided with a plurality of grooves 28. While the grooves are not necessary, they facilitate the placement and secure mounting of plates 30 in tank 10. Plates 30 function as electrodes of the hydrolyzer.

Electrodes 30 are made of stainless steel, for example 316L. The material is selected for its paramagnetic properties. Most effective operation with this material has been achieved by conditioning the electrodes by running a hydrolyzer cell for an extended period of time, periodically scrubbing the electrodes with an abrasive member to remove accumulated deposits. The electrolyzer is run by the application of a voltage to the positive end electrode 32 and the negative end electrode 34. Electrodes between positive end electrode 32 and negative end electrode 34 are not directly connected to electricity 5 wires, but together with the electrolytic sodium hydroxide solution contained in tank 10 form an array of electrodes which are connect in a series electrical circuit. It is believed that constituent metals of the stainless steel plates which are subject to fouling (apparently primarily iron oxides) are oxidized during operation of the electrolyzer through the application of a voltage to the positive end electrode 32 and the negative end electrode 34.

In accordance with the invention, the plates which form the electrodes may be sanded or abraded to increase the surface area.

Because of the accumulation of iron oxide and perhaps other deposits on the electrodes during conditioning, mechanical scrubbing of the electrodes (as will be detailed below) is performed in accordance with the present invention. This may be achieved using any suitable means. This should be done periodically during the conditioning of the electrodes, for example by initial operation of a hydrolyzer 1, or in a cell dedicated to the conditioning process. During this conditioning process hydrogen and oxygen are released from opposite sides of the plates.

It has been discovered that after the initial conditioning process, analysis of the surface of the opposite sides 36 and 38 of the electrodes, compared to the composition of stainless steel SST 316L, shows the following constituents:

| SST 316L | | Plate Side 36 Oxygen | | Plate Side 38 Hydrogen | |
|---|---|---|---|---|---|
| O | — | O | 36.09 | O | 21.11 |
| Na | — | Na | 33.81 | Na | 19.22 |
| C | 0.03 | C | 22.19 | C | 36.69 |
| Fe | Bal | Fe | 6.05 | Fe | 15.33 |
| Cr | 16-18 | Cr | .84 | Cr | 4.18 |
| Ca | — | Ca | .29 | Ca | .22 |
| Ni | 10-14 | Ni | .22 | Ni | 2.38 |
| Al | — | Al | .37 | Al | — |
| Mo | 2-3 | Mo | .08 | Mo | .35 |
| Si | 1 | Si | .05 | Si | — |
| Ce | — | Ce | — | Ce | .06 |
| Mn | 2 | Mn | — | Mn | .46 |
| P | .045 | P | — | P | — |
| S | .03 | S | — | S | — |

The analysis method used was chromo-spectrographic imagery. Surfaces 36 are the sides of the electrodes at which oxygen is released. Surface 38 is the side of the electrodes at which hydrogen is released. It is believed that fabricating a plate with the composition of one or more of the metals for plate sides 36 and 38 (and perhaps not including iron) indicated in the above table may result in an acceptable electrode without any (or perhaps a reduced) need for the initial electrode conditioning process described above.

In accordance with the invention, electrodes 30, 32 and 34 are made of Stainless steel 316L and have a thickness of 16 gauge, but any convenient thickness will work. Electrodes have a length and width calculated to fit securely within grooves 26 and 28 on the sides and the bottom of tank 10.

Figure 2:
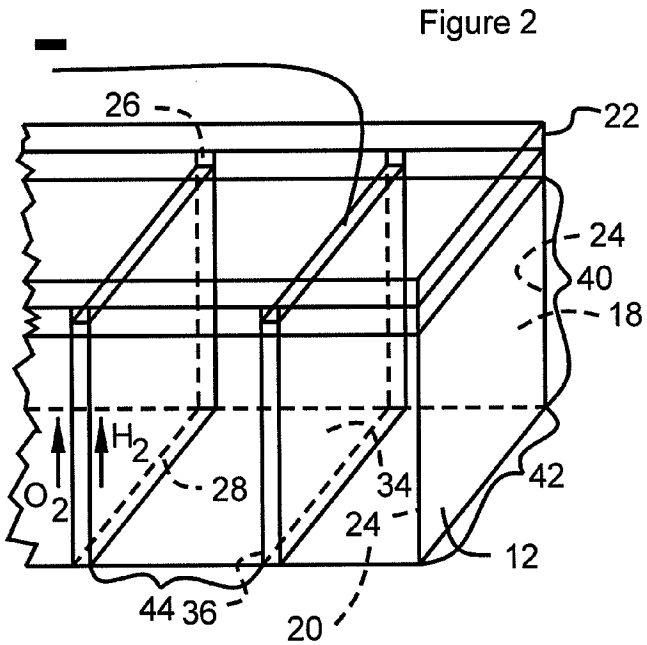
FIG. 2 is a schematic diagram, similar to FIG. 1, in which the details of construction of the system are illustrated.

In accordance with the invention, as illustrated in FIG. 2, the electrodes formed by plates 30, 32 and 34 have a height 40 of approximately six inches, and a width 42 of approximately six inches, but may be any size and proportion, as may be needed to meet any particular demand for the production of hydrogen and oxygen. Likewise, the electrodes have a wide range of thicknesses, selected mainly to accommodate physical handling and mechanical integrity of the same. In the case of a cell constructed for the purpose of conditioning electrodes, the electrodes are separated by a gap 44 of 0.125 inches, as illustrated in FIG. 2. It is noted for the sake of clarity that FIG. 2 is not drawn to scale for purposes of clarity of illustration.

Figure 4:
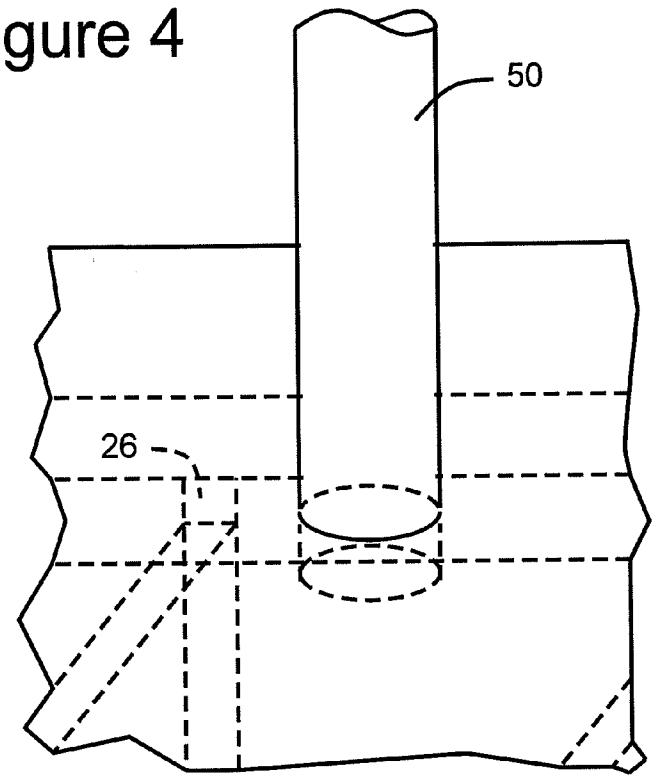
FIG. 4 is a schematic diagram illustrating structure for the collection of Hydrogen and oxygen gas generated according to the present invention.
Figure 3:
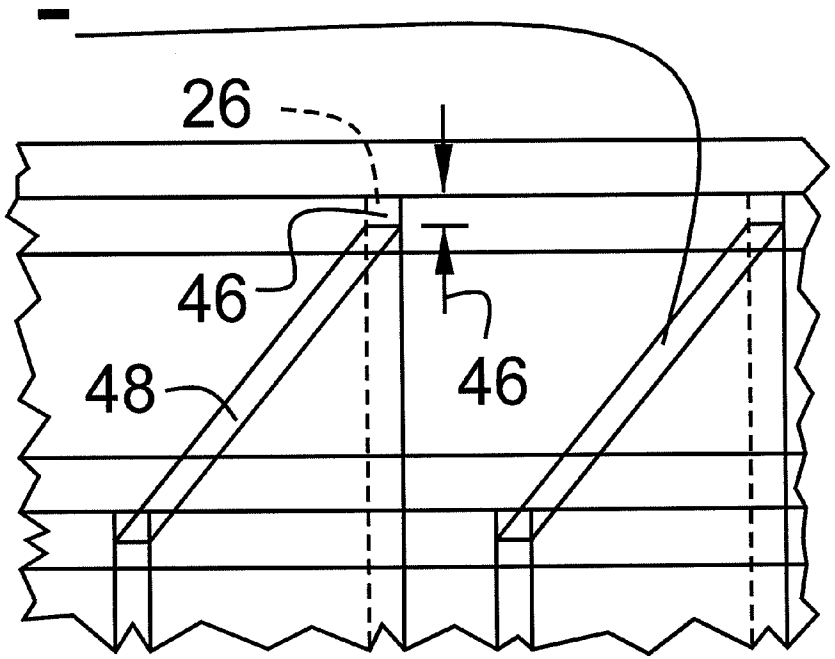
FIG. 3 illustrates schematically the desirable clearance between the top of the liquid and the top of the electrode in a hydrolyzer or an electrode conditioning device and a desirable clearance between the top of the electrodes in the lid closing of the tank portion of an electrolyzer.

The height 40 of the electrodes is selected to be higher than the level of liquid in the cell, but is low enough to allow a clearance 46 of approximately 0.25 inches, as illustrated in FIG. 3. This results in the creation of a manifold space between the tops 48 of the electrodes and the bottom of top cover 22. Both hydrogen and oxygen created on opposite sides of the electrodes during the operation of electrolyzer 1 are thus collected and to some extent mixed in this manifold space from which they enter tube 50, as illustrated in FIG. 4. Tube 50 is coupled, for example, to the air intake of an internal combustion engine through a bubbler, in accordance with the invention.

In accordance with the invention, there are various electrodes in tank 10 when the object of the operation of the system is to condition electrodes for use in an electrolyzer. In the case of a device meant to provide hydrogen and oxygen gas to an engine, end electrodes 32 and 34 are connected to the positive and negative terminals of a battery. It is noted that the number of electrodes and their dimensions are not to scale in FIG. 1, which is laid out primarily to clearly illustrate the nature of the structures involved. The remaining electrodes 30 between end electrodes 32 and 34 are not directly connected to the battery. However, because they are positioned between electrodes 32 and 34, they are in a series electrical circuit and have a voltage across them. The battery is continuously being recharged by the generator of the engine, in a conventional manner.

The voltage across each pair of adjacent electrodes is in the range of 2.1 to 2.5 volts when voltage is applied across the electrolyzer during the initial operation of the electrolyzer. As noted before, this initial operation serves as a conditioning period. During such conditioning, reddish iron deposits build up on the electrodes which must be removed and periodically scrubbed.

In accordance with the invention, initial conditioning by operation of the electrolyzer 1 is usually continued for approximately 36 hours.

The analysis of the plates noted above, indicates that the red material forming on the electrodes is an iron compound. Thus, scrubbing removes iron compounds from the surface of the stainless steel electrodes, leaving a substantially paramagnetic surface.

In accordance with a preferred embodiment of the invention, it is believed advantageous, after several hours of operation for example twelve hours, for tank 10 to be drained and conditioning to be continued by the introduction of second solution, comprising a fresh mixture of triple distilled water, sodium hydroxide and high ORP catalyst prepared as detailed above and introduced into the tank. However, in the second solution, the amount of high ORP catalyst is doubled. More particularly, high ORP catalyst is incorporated in a ratio of 2 teaspoons of the catalytic high ORP fluid to 1 gallon water. After the replacement of the fluid in the tank, the conditioning process is continued, as described above with periodic scrubbing of electrodes to remove accumulated materials, such as iron oxides.

After another three to five days, a layer of material is formed on the surface of the steel. It appears that the surface is simply in large measure nonferrous components of the stainless steel, as detailed in chart herein. It is a layer of a new catalyst, formed from the combination of the ORP materials and the low oxidative metals, Chromium and Molybdenum which are components of the stainless steel electrodes.

During the burning or conditioning process described above, generally a voltage of between 2.1 and 2.5 volts may be measured across adjacent electrodes as a result of the application of voltage to end electrodes 32 and 34. As noted above, the burning process, while it may be viewed as a plate conditioning process, may, effectively, also be viewed as the initial operation period for an electrolyzer. Accordingly, hydrogen and oxygen are released during this process and should be appropriately treated.

In accordance with the invention, it has been found that it may be necessary to continue burning or conditioning the plates for 3-5 days, 24 hours a day.

It is believed that the electrode conditioning process described above results in the high ORP catalyst bonding with the chromium and molybdenum of the stainless.

After the iron is burned off the stainless steel electrodes during the initial operation of electrolyzer 1 (which condition is indicated by the cessation of the formation of red deposits on the electrolyzer plates) the electrodes may be considered to be conditioned and the electrolyzer may, in principle, be ready to be used. However, in accordance with a preferred embodiment, the conditioned electrodes are placed in an electrolyzer particularly designed for a specific purpose and generally of a more compact design. This is possible because the electrodes surfaces have been treated, and harmful accumulations and deposits at the bottom of the tank are largely eliminated.

After burning or conditioning of the electrodes has been completed, it has been observed that the side of the electrode which releases oxygen is a darkish color. Similarly, after burning has been completed, it has been observed that the side of the electrode which releases hydrogen is somewhat gold in color.

During the operation of the inventive electrolyzer, as illustrated in FIG. 1, twelve volts is applied across electrolyzer 1. However, can be made to operate with different voltages depending on the conditions of the engine or desired results. Similarly, the voltages could be pulsed instead of steady. More particularly, the inventive electrolyzer 1 may have electrode 32 coupled to the positive side of the automobile battery, while electrode 34 is coupled to the negative side of the automobile battery.

Figure 5:
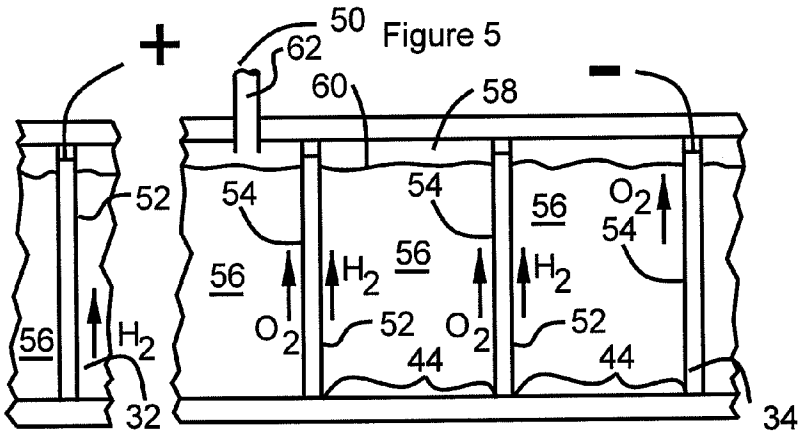
FIG. 5 is a schematic cross-section overview of the inventive system.

As a result of the application of voltage between end electrodes 32 and 34, electrolysis occurs and Hydrogen comes off the negative sides 52 of the electrodes, as can be seen in FIG. 5. Oxygen comes off the positive sides 54 of the electrodes.

The production of hydrogen and oxygen is caused by the dissociation of hydrogen and oxygen atoms in the water which is one of the constituents of solution 56.

As the aqueous component of the liquid in tank 10 is consumed by being converted into hydrogen and oxygen, water must be added to the tank which forms hydrolyzer 12. The water to be added is triple distilled water and more particularly the liquid added to tank 10 comprises six parts triple distilled water to one part energized water. This mixture is prepared by pouring energized water into triple distilled water.

The molecules of Hydrogen and Oxygen formed adjacent the electrodes are mixed in the manifold space 58 above the level 60 of solution 56 and the bottom of cover 22.

In accordance with a preferred embodiment of the invention, it is contemplated that the cover 22 is sealed to tank 10. Tank 10 and cover 22 may also be made of any appropriate material, with the object of reinforcing and containing the system.

It is also contemplated that a suitable release mechanism may be employed, referred to as a safety bubbler with a release valve for the neutralization of any pressure.

In accordance with a preferred embodiment of the invention, the plates prepared, as detailed above, may be removed from a conditioning cell, as described above, to make a compact, long-lived and efficient electrolyzer suitable for incorporation in conjunction with an engine.

In accordance with a preferred embodiment of an engine application electrolyzer, the tank of the application electrolyzer is filled with a solution of distilled water, energized water, sodium hydroxide and high ORP catalyst.

In accordance with the invention, it is contemplated that any level of sodium hydroxide solution in the electrolyzer will not exceed the height of the electrodes, as illustrated in FIG. 5.

Engine electrolyzer includes suitable number of plates, and receives appropriate input from power source. The electrode plates are separated by 0.125 inches, as noted above, and a voltage of 2 volts has been measured between adjacent electrode plates. It may, depending upon the design of the engine involved, be desirable to use a larger battery and generator in view of the added electrical load introduced by the inventive electrolyzer.

The engine electrolyzer described above will produce about 300 liters of gas comprising a mixture of oxygen and hydrogen per hour. This gas accumulates in the manifold space 58, from which it feeds into output tube 62 which is connected to the air intake of the internal combustion engine powering the automobile.

In accordance with a preferred embodiment, the length of the coupling between the electrolyzer and the air intake is as small as possible. Thus, the mixture of hydrogen and oxygen is sent to the engine substantially simultaneously with its production. The gas thus sent to engine is mixed with air and is ignited in the combustion chamber. The result is to make to the gasoline or other fuel more completely combustible, thus resulting in substantially reduced pollutants and increased power.

As alluded to above, it is believed that by fabricating the electrodes of appropriate materials, for example those materials indicated in the above chart, perhaps without the inclusion of any iron, the need for the electrode conditioning process may be eliminated.

In the system of the present invention, as described above, the sodium hydroxide solution is a highly efficient vehicle for water separation. The sodium hydroxide has increased the conductivity of the distilled water to allow the electricity to pass through it and dissociate the molecular bonds between the oxygen and hydrogen atoms in the water and hence facilitate separation. As alluded to above, in accordance with the invention, electrolyzer 1 is carried on board a vehicle, such as an automobile or any engine application. The system also involves minimal added complexities, because the electrolyzer 1 is powered by the generator of the vehicle and is connected to the automobile engine merely by adding an input port to the air intake to the engine.

It is believed that the relatively short path between the plates where the hydrogen and oxygen are generated and the input to the engine, and the fact that the gas is consumed substantially as it is produced, with a minimal delay in time results in the fact that the hydrogen produced is largely parahydrogen and this is believed, in accordance with the present invention, to be more effective in promoting combustion and reducing pollution.

It has been shown that hydrogen gas under ordinary conditions is a mixture of two kinds of molecules, known as ortho- and para-hydrogen, which differ from one another by the spins of their electrons and nuclei. Normal hydrogen at room temperature contains 25% of the para form and 75% of the ortho form. The ortho form cannot be prepared in the pure state. Since the two forms differ in energy the physical properties also differ.

These two forms of hydrogen are referred to as spin isomers of hydrogen. In these species, the hydrogen molecule consists of two hydrogen atoms linked by a covalent bond. If we neglect the traces of deuterium and tritium which could be present in any sample of hydrogen, each hydrogen atom consists of one proton and one electron. The proton has an associated magnetic moment, which we can treat as being generated by the proton's spin. The spins of the two hydrogen atoms can either be aligned in the same direction (this is orthohydrogen) or in opposite directions (this is parahydrogen).

The ratio between the ortho and para forms is about 4:1 at standard temperature and pressure, but the para form dominates at low temperatures (approx. 99.95% at 20 K).

Orthohydrogen is unstable at low temperatures and spontaneously changes into parahydrogen, but the process is slow because the kinetic barrier to interconversion is high. The conversion from ortho to para state is exothermic (releasing heat). The presence of an orthomagnetic substance in liquid hydrogen can induce rapid heating—an undesirable occurrence when one wants hydrogen to remain liquid. At room temperature, hydrogen contains 75% orthohydrogen, a proportion which the liquefaction process preserves. The first synthesis of pure parahydrogen was achieved by Paul Harteck and Karl Friedrich Bonhoeffer in 1929.

The high ORP catalyst fluid used in accordance with the invention is non-corrosive, with a high Ph and very high ORP. This fluid, which is amber in color, has been found to have a Ph of between 12 and 14 and an oxygen reduction potential of between −150 to −250. This compares with the pH of sodium hydroxide which is 12-14. The high ORP catalyst is prepared, in accordance with the invention, by heating a solution of sodium hydroxide from a natural source and filtering the same, as appears more fully below. Observation has shown that with the addition of the high ORP fluid, the efficiency of the electrolysis process is significantly increased to the point of being viable as an add-on to an internal combustion engine which will provide additional power and reduced emissions.

The high ORP catalyst is a fluid and is prepared by using a resinous tree bark as a starting material. The same is burned, resulting in the creation of a light ash or raw pot ash. Potash is in large part sodium hydroxide and is the traditional source of this compound, but, in the case of resinous vegetable materials, it also contains other materials and may be refined to produce the desired catalyst.

While other parts of the tree may be used, in accordance with a preferred embodiment of the invention, pinyon pine bark is, most preferably, burned to make ash. While only preliminary work has been done with other woods, it is believed that ponderosa pine and other closely related species (e.g., other species of subgenus: Ducampopinus) may also work.

In addition to the bark, other resinous parts of the wood, such as the pinecones, the layer of wood closest to the bark, new growth, and needles are believed to be particularly effective.

It is believed that the metabolic systems in trees of the resinous type generate complex organic materials with a high degree of stability and anti-fouling potential.

In accordance with the invention burning of the organic material is done in a manner conventional to that for the generation of potash.

In accordance with the invention it is contemplated that the formation of ash should proceed until the ash is substantially without charcoal remaining in the combustion product.

In accordance with the invention, it is necessary that sufficient heat be generated for a long enough time to convert all components of the wood and associated vegetable matter to ash.

When it is necessary to add additional highly resinous wood components to the stove, the process is continued with the objective of generating more ash as a source material for catalyst. More particularly, at that time, the stove is filled with wood again with proportions and quantities of the thicknesses of large wood, followed by closely packed highly resinous components noted above.

Generally, it was found that the desired gray ash was located on the top of the ash layer.

More completely burned white ash, typically located below the gray ash, was not found to be the most desirable source of the materials from which to refine the catalyst.

Figure 6:
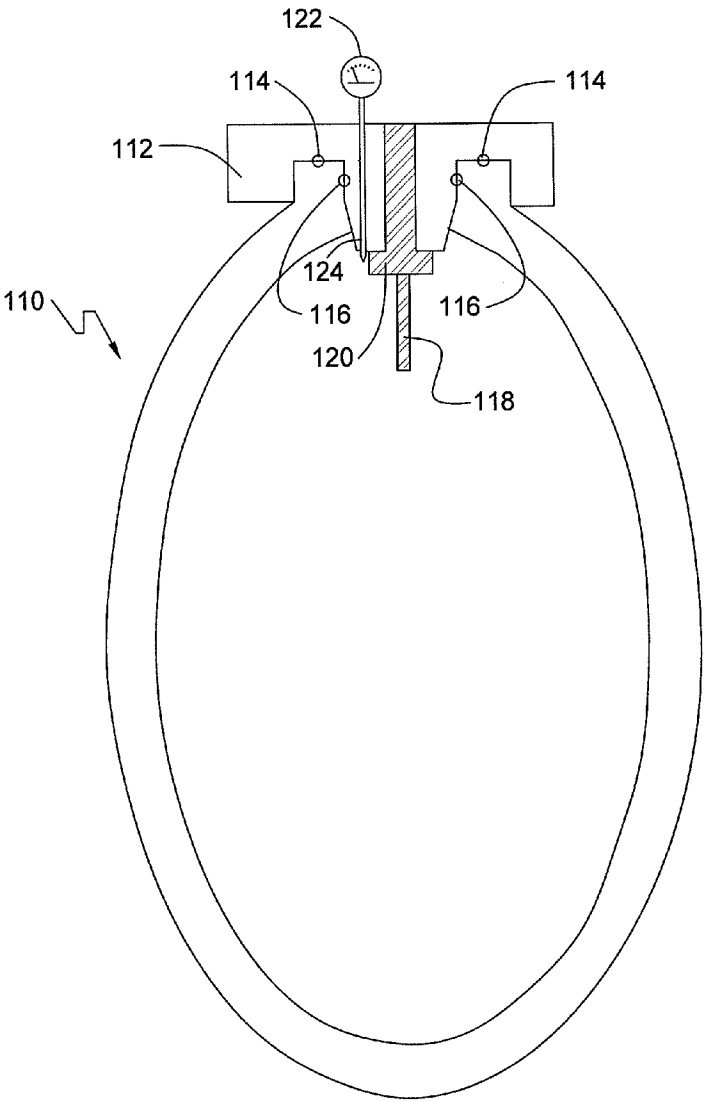
FIG. 6 illustrates apparatus for practicing the inventive method for the preparation of the inventive catalytic agent.

After the desired ash has been collected, in order to make the catalytic fluid, approximately 300 ml of dry collected ash is placed in a vessel 110 having the shape illustrated in FIG. 6. In accordance with a preferred embodiment, ash used in the method is of relatively fine dimension, for example in the range of 1000 to 5000 nm in diameter. In order to achieve this particle size, the ash should be ground, for example, using a ball mill.

One gallon of triple distilled water is also placed in vessel 110. Vessel 110 is then hermetically sealed. The dimensions of vessel 110 are an inside height of eight inches and an inside diameter at its center (the maximum diameter) of five inches. Vessel 110 has a wall thickness of about one inch and is made of high grade paramagnetic stainless steel. After being placed in vessel 110, frustro-conical stopper 112 is put in position as illustrated in FIG. 6. Stopper 112 is sealed in position by an O-ring 114 and a second O-ring 116.

The contents of vessel 110 are then shaken to disperse and/or dissolve components of the ash in the distilled water. Stopper 112 incorporates a heating element 118 supported within mounting member 120. A thermal sensor 122 incorporates a probe 124 which measures the temperature within the vessel 110. In addition, means may be provided for measuring the pressure of the fluid within vessel 110.

Once the material is placed inside, the vessel is sealed so that no air is left inside and the pressure is raised to 1000 psig. As this is being done, the temperature is raised until the outside temperature reaches 300 degrees Fahrenheit. The vessel is then shaken vigorously to allow the materials to mix.

Shaking is performed during the heating process and at the end of the heating process.

The vessel may be cleaned using a brass scrub brush which is 18 inches long.

Heating element 118 is then activated, resulting in heating the fluid within vessel 110 and increasing the pressure within the vessel. In accordance with the invention, the material in vessel 110 is pressurized up to or in excess of 1000 psig, for a sustained period of time up to 3 hours.

In accordance with the preferred embodiment of the invention, it is contemplated that vessel 110 is made of a paramagnetic material, more particularly a paramagnetic grade of stainless steel. After the heating process is completed, the contents of vessel 110 are allowed to cool linearly to room temperature for a period of 24 hours. No agitation is applied during this 24-hour cooling process.

The vessel has a threaded cap that will seal itself stronger as the pressure increases. Through the cap is inserted a heating element that is used to heat the material inside. The heating element is insulated from the metal of the vessel to avoid heat transfer to the shell and maximize the transfer to the material.

A gauge and pressure fitting is attached to the cap to both pressurize the vessel and measure the pressure.

The contents of vessel 110 is heated by internal heating element 118, which draws about 20 amperes at 240 volts, consuming about 2000 watts. Element 118 is activated until the outside temperature of vessel 110 reaches 300 degrees Fahrenheit. Heating element 118 is turned on and off periodically in order to maintain that temperature in the manner well known in the art, for example using a thermostatic sensor whose contact probe touches the outside of the vessel. A cross check on temperature is provided by thermostatic sensor 122.

After the outside temperature 300.degree.F. has been maintained for about three hours, actuation of heating element 118 is continued for a 24-hour period in a manner which provides for linear decrease in temperature from 3000 Fahrenheit to 70.degree. Fahrenheit over a period 24 hours.

After this, one first pours off the liquid allowing the material which has settled at the bottom of vessel 110 to remain in vessel 110. This remaining material is distorted. The poured off liquid is then filtered using a paper filter, being careful to note that the filter material may be degraded.

The resulting catalytic fluid has a Ph level of between 12 and 14 but appears to be non-toxic and non-reactive to human tissues. It has a golden yellow-amber color.

In accordance with a preferred embodiment of the invention, the oxygen and hydrogen gasses provided by the electrolyzer are washed and utilized together by being fed into the air intake of the engine to facilitate a more efficient combustion of hydrocarbons in the internal combustion engine.

It is also noted that the inventive electrolyzer may be used in any device which burns fuel, for example fossil fuel, such as an oil burner, in order to achieve increased combustion efficiency. Applications include refineries, mills, chemical plants, foundries, waste processing, etc.

It is noted that while the use of the inventive hydrogen and oxygen dissociation apparatus has been described in the context of improving combustion efficiency in an internal combustion engine, it is contemplated that the generated gasses may be introduced into other systems burning fuel, including diesel engines, heating systems, kerosene burning systems, biofuel burning engines and combustion devices and so forth.

While an illustrative embodiment of the invention has been described, it is understood that the invention is defined and limited only by the appended claims.

What is claimed is:

1. A method comprising:

combining an agent having an oxidation reduction potential that is one of either:

a) −150 or more negative; or b) +150 or more positive with a buffer and water that is free of minerals, thereby forming a mixture;

forming conditioned electrodes in a first container by exposing a plurality of electrodes to the mixture and subjecting the electrodes to an electrical potential; and generating hydrogen and oxygen by:

(i) removing the condition electrodes from the first container;

(ii) placing the conditioned electrodes in a second container; and (iii) electrically coupling the conditioned electrodes to a source of electricity.

2. The method of claim 1 wherein the operation of forming conditioned electrodes further comprises periodically cleaning a surface of the electrodes.

3. The method of claim 1 wherein the operation of forming conditioned electrodes further comprises subjecting the electrodes to an electrical potential for a period of time sufficient to form a layer of material on a surface of the electrodes, wherein the layer comprises substantially non-ferrous elements.

4. The method of claim 1 wherein the electrodes comprise stainless steel.

5. The method of claim 1 and further comprising adding the mixture to the second container.

6. The method of claim 1 and further comprising delivering at least one of the generated hydrogen and the generated oxygen to a combustion device.

7. The method of claim 1 and further comprising adding at least one of the generated hydrogen and generated oxygen to a fuel.

8. The method of claim 1 wherein the generated hydrogen comprises relatively more para hydrogen than is present at standard temperature and pressure conditions.

9. An apparatus comprising a hydrolyzer, wherein the hydrolyzer comprises:

a plurality of electrodes, wherein a surface of each electrode of the plurality thereof comprises oxygen, sodium, and carbon in an amount that is collectively at least 75 weight percent of the constituents of the surface; and an electrically-conductive fluid, wherein the plurality of electrodes are exposed to the electrically-conductive fluid.

10. The apparatus of claim 9 wherein each electrode in the plurality thereof is formed by:

(a) combining an agent having an oxidation reduction potential in a range of about −150 to about −250 with a buffer and water that is free of minerals, thereby forming a mixture; and (b) exposing a plurality of electrodes to the mixture and subjecting the electrodes to an electrical potential.

11. The apparatus of claim 9 wherein the electrically-conductive fluid comprises a conductivity-promoting material and water.

12. The apparatus of claim 9 further comprising a coupling suitable for delivering, to a fuel, at least one of hydrogen and oxygen that is generated via the hydrolyzer.

13. The apparatus of claim 9 further comprising a coupling suitable for delivering, to an air intake of a combustion device, at least one of hydrogen and oxygen that is generated via the hydrolyzer.

14. The apparatus of claim 9 wherein the apparatus further comprises:

a source of electricity, wherein hydrolyzer is electrically coupled to the source of electricity; and a combustion device, wherein the combustion device is fluidically coupled to the hydrolyzer to receive hydrogen therefrom.

15. The apparatus of claim 14 wherein the combustion device burns a fuel selected from the group consisting of gasoline, diesel, alcohol, petroleum biofuel, biological derivatives, and petroleum derivatives.

16. A combustion system comprising:

a source of electricity;

a hydrolyzer, wherein the hydrolyzer is electrically coupled to the source of electricity, and further wherein the hydrolyzer includes:

(a) an electrically conductive fluid;

(b) a plurality of conditioned electrodes that are exposed to the electrically conductive fluid, wherein the conditioned electrodes have a surface composition in which iron, chromium, and nickel collectively account for less than about 20 weight percent thereof and oxygen, sodium and carbon collectively account for at least 75 weight percent thereof;

a combustion chamber, wherein the combustion chamber includes an inlet for air;

a conduit, wherein the conduit conducts hydrogen and oxygen generated via the hydrolyzer to a location wherein it is mixed with the air intended for the inlet of the combustion chamber.

17. The combustion system of claim 16 wherein the conditioned electrodes are formed by:

(a) combining an agent having an oxidation reduction potential that is either:

(i) −150 or more negative; or (ii) +150 or more positive with a buffer and water that is free of minerals, thereby forming a mixture; and (b) exposing a plurality of electrodes to the mixture and subjecting the electrodes to an electrical potential.

18. The combustion system of claim 16 wherein the conditioned electrodes are formed by:

exposing electrodes to a mixture comprising:

(i) water;

(ii) a buffer; and (iii) a catalyst that is formed by burning resinous vegetable material to ash and mixing the ash with water and exposing same to elevated temperature and pressure; and subjecting the electrodes to an electrical potential.

19. The combustion system of claim 16 further comprising an internal combustion engine, wherein the combustion chamber is a part of the internal combustion engine.

* * * * *